US009215924B2

(12) United States Patent
Seefeldt et al.

(10) Patent No.: US 9,215,924 B2
(45) Date of Patent: Dec. 22, 2015

(54) MOBILE FURNITURE SYSTEM

(71) Applicant: Hamilton Scientific LLC, De Pere, WI (US)

(72) Inventors: David A. Seefeldt, Mishicot, WI (US); Michael A. Holzer, Two Rivers, WI (US); Robin E. Hecker, Manitowoc, WI (US)

(73) Assignee: Laboratory Solutions International, LLC, Manitowoc, WI (US)

( * ) Notice: Subject to any disclaimer, the term of this patent is extended or adjusted under 35 U.S.C. 154(b) by 0 days.

(21) Appl. No.: 14/273,073

(22) Filed: May 8, 2014

(65) Prior Publication Data

US 2014/0331901 A1 Nov. 13, 2014

Related U.S. Application Data

(60) Provisional application No. 61/821,467, filed on May 9, 2013.

(51) Int. Cl.

| | |
|---|---|
| ***A47B 21/00*** | (2006.01) |
| ***A47B 21/06*** | (2006.01) |
| ***A47B 13/02*** | (2006.01) |
| ***A47B 37/00*** | (2006.01) |

(52) U.S. Cl.

CPC ..... *A47B 21/06* (2013.01); *A47B 13/02* (2013.01); *A47B 37/00* (2013.01); *A47B 2021/066* (2013.01); *A47B 2037/005* (2013.01)

(58) Field of Classification Search

CPC .. A47B 91/00; A47B 91/9102; A47B 91/022; A47B 91/024; A47B 91/026; A47B 91/16; B60B 33/00; B60B 2033/0034; B60B 33/04; B60B 33/06

See application file for complete search history.

(56) References Cited

U.S. PATENT DOCUMENTS

| | | | | |
|---|---|---|---|---|
| 1,017,464 | A * | 2/1912 | Rae | 16/32 |
| D220,703 | S | 5/1971 | Deguchi | |
| 3,650,586 | A | 3/1972 | Nightingale et al. | |
| 3,844,578 | A * | 10/1974 | Matyskella et al. | 280/43.22 |
| 3,920,299 | A | 11/1975 | Propst et al. | |
| 4,002,383 | A | 1/1977 | Holloway, Jr. | |
| D244,913 | S * | 7/1977 | Brandenfels | D6/462 |

(Continued)

OTHER PUBLICATIONS

Fisher Hamilton LLC, Brochure for Distinction Laboratory Bench System, Jan. 2005, 8 pgs.

(Continued)

*Primary Examiner* — Daniel Rohrhoff

(74) *Attorney, Agent, or Firm* — Boyle Fredrickson, S.C.

(57) ABSTRACT

A mobile furniture system includes a work surface and a framework assembly, which includes a pair of vertical frame members to support the work surface. The frame members extend above the work surface. At least one utility service line is routed through the framework assembly. A rotatable support may be operatively coupled to each frame member. The rotatable support includes a housing and a rotatable wheel. At least a portion of each of the rotatable supports is in vertical alignment with one frame member. A pair of leg members is operatively coupled to the work surface and is spaced from the pair of frame members. Another rotatable support is coupled to each leg member. A movable foot may be coupled to each of the frame members and to each of the leg members to support the system in a stationary configuration upon a lowering movement of the movable foot.

18 Claims, 7 Drawing Sheets

(56) References Cited

U.S. PATENT DOCUMENTS

| | | | | |
|---|---|---|---|---|
| 4,050,752 | A | 9/1977 | Dykstra | |
| 4,077,086 | A * | 3/1978 | Butler | 16/33 |
| D257,093 | S | 9/1980 | Brittner | |
| 4,941,412 | A | 7/1990 | Engel | |
| D321,447 | S | 11/1991 | Newhouse | |
| D330,940 | S | 11/1992 | Engel | |
| 5,339,747 | A | 8/1994 | Epps | |
| D376,705 | S | 12/1996 | Stoddard et al. | |
| 5,638,759 | A | 6/1997 | Klugkist | |
| 5,879,185 | A | 3/1999 | Handler et al. | |
| 5,901,513 | A | 5/1999 | Mollenkopf et al. | |
| 5,971,350 | A * | 10/1999 | McCutcheon | 248/688 |
| 5,997,397 | A | 12/1999 | Frickel et al. | |
| 6,029,832 | A | 2/2000 | Bastian | |
| 6,047,838 | A | 4/2000 | Rindoks et al. | |
| 6,112,913 | A | 9/2000 | Rindoks et al. | |
| 6,115,978 | A | 9/2000 | Bastian et al. | |
| 6,138,583 | A | 10/2000 | Mahone et al. | |
| 6,284,975 | B1 | 9/2001 | McCord et al. | |
| 6,374,548 | B1 | 4/2002 | Ruedinger et al. | |
| D465,359 | S | 11/2002 | Kolberg | |
| 6,520,460 | B2 * | 2/2003 | Hallberg et al. | 248/188.5 |
| 6,591,449 | B1 * | 7/2003 | Parkin | 16/35 R |
| D483,968 | S | 12/2003 | King et al. | |
| D508,343 | S | 8/2005 | Pflaster | |
| D587,485 | S | 3/2009 | Albright | |
| 7,634,967 | B1 * | 12/2009 | Albright et al. | 108/50.02 |
| 7,712,847 | B1 | 5/2010 | Albright et al. | |
| 7,735,433 | B1 | 6/2010 | Albright et al. | |
| 8,186,281 | B2 | 5/2012 | Bastian et al. | |
| 8,650,710 | B1 * | 2/2014 | Waggener | 16/18 B |
| 2003/0089283 | A1 | 5/2003 | Okamoto et al. | |
| 2005/0183874 | A1 | 8/2005 | Vargas et al. | |
| 2007/0204537 | A1 * | 9/2007 | Bastian et al. | 52/220.7 |
| 2008/0042023 | A1 * | 2/2008 | Williams | 248/188.1 |
| 2012/0217358 | A1 * | 8/2012 | Arslankiray et al. | 248/188.4 |

OTHER PUBLICATIONS

Fisher Hamilton LLC, Brochure for MAX/Wall Technical Wall System, May 2002, 12 pgs.

* cited by examiner

MOBILE FURNITURE SYSTEM

CROSS-REFERENCE

This application claims priority to U.S. Provisional Patent Application Ser. No. 61/821,467 filed May 9, 2013 (Pending), the disclosure of which is incorporated by reference herein in its entirety.

FIELD OF THE INVENTION

The present invention relates generally to furniture systems and, more particularly, to mobile furniture systems suitable for use in various laboratory and other environments.

BACKGROUND OF THE INVENTION

Furniture systems that can be moved to different locations within a facility are desirable in many applications and environments, such as laboratories, product inspection stations, manufacturing assembly stations, and clean rooms, for example. The mobility of such systems may provide improved flexibility for that environment. Typically, furniture systems include a tabletop, or other generally planar work surface, and may be adapted to support shelving, drawers, dividers, suspended cabinets, tack boards, and various other accessories. During use, furniture systems are typically loaded with laboratory equipment, analytical instrumentation, computers, other types of equipment, and files. In many applications, it may be desirable to provide various utility sources, such as electric, data, gas, fluid and vacuum services, at or near the work surface to facilitate the performance of various tasks.

Due to their size and weight and because they often support any or all of the above listed equipment, typical furniture systems cannot be conveniently and safely relocated. Moving a typical furniture system may require that any equipment, particularly valuable analytical equipment, must be removed from the furniture system and separately moved. And, due to their weight, furniture systems may require at least partial disassembly so that they may be carried to the new location where they may be then reassembled. In addition, even in situations in which some disassembly is undertaken, typical furniture systems may generally require multiple people to carry the disassembled components to the new location before being reassembled.

Alternatively to disassembly of the furniture system, a pallet jack or forklift may be utilized to move the furniture system as a whole. While this may be accomplished without initially unloading the above-identified equipment, utilizing a pallet jack or forklift may be limited to locations which are accessible to these machines because pallet jacks and forklifts are often large bulky machines that require significant space within which to maneuver. As such, space restrictions around the furniture system, such as the presence of other furniture and equipment, may prohibit access via a pallet jack or forklift and thus inhibit convenient relocation of the furniture system. Furthermore, space restrictions within the facility itself, such as, doorways, stairs, and/or elevators, between the current location of the furniture system and the new location for the furniture system may limit use of pallet jacks and forklifts.

Known mobile furniture systems are generally incapable of carrying sufficient weight and are often prone to tipping when being relocated. These furniture systems may include a supporting base including wheels to facilitate relocation of the furniture. However, a small amount of tilt as the result of being moved along an incline or across a threshold which inadvertently catches one wheel, may cause the system to become unstable, and, absent external application of a force to counteract gravity, inadvertent tilting may have catastrophic consequences and may cause injury and/or destruction of equipment.

Accordingly, there is a need for improvements to mobile furniture systems that improve the mobility and stability of such furniture systems while also maintaining or improving their aesthetic appearance.

SUMMARY OF THE INVENTION

The present invention overcomes the foregoing and other shortcomings and drawbacks of mobile furniture systems heretofore known for use in suitable various laboratory and other environments. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a mobile furniture system comprises a work surface that defines a workstation and a framework assembly that comprises a pair of vertical frame members configured to support the work surface. Each of the vertical frame members extends above the work surface. The mobile furniture system further comprises at least one utility service line that is routed through at least a portion of the framework assembly and is configured to be removably coupled to at least one fixed utility source. The system further comprises a first rotatable support that is operatively coupled to each of the vertical frame members. The first rotatable support comprises a housing and a rotatable wheel that is supported by the housing. At least a portion of each of the rotatable supports is in vertical alignment with a respective one of the vertical frame members. The system further comprises a pair of leg members that are operatively coupled to the work surface and are spaced from the pair of vertical frame members. The system further comprises a second rotatable support that is operatively coupled to each of the pair of leg members.

According to one aspect of the present invention, the framework assembly includes a first stretcher member that extends between the pair of vertical frame members and a second stretcher member that extends between each one of the front leg members and a respective one of the vertical frame members.

According to one aspect of the present invention, the work surface has a front edge and a rear edge and the vertical frame members support the work surface proximate the rear edge. The rear edge is generally in alignment with a rear side of each vertical frame member.

According to one aspect of the present invention, the work surface has a front edge and a rear edge and the vertical frame member supports the work surface proximate the rear edge. The rear edge extends rearwardly beyond a vertical midplane of each vertical frame member.

According to one aspect of the present invention, each of the vertical frame members includes a plurality of apertures that are configured to removably mount a shelf to the vertical frame members that overlies the work surface.

According to one aspect of the present invention, the work surface includes a front edge and a rear edge, and a rear side of each of the vertical frame members that faces away from the front edge is free of apertures.

According to one aspect of the present invention, the work surface includes a raised lip located proximate each of the vertical frame members.

According to one aspect of the present invention, at least one of the first and/or second rotatable supports comprises a caster. The caster may be a swivel caster, a leveling caster, or a swivel leveling caster.

According to another aspect of the present invention, a single-sided mobile furniture system comprises a work surface that defines a workstation and a framework assembly that comprises a pair of vertical frame members configured to support the work surface. Each of the vertical frame members extends above the work surface. At least one utility service line is routed through at least a portion of the framework assembly and is configured to be removably coupled to at least one fixed utility source. The mobile furniture system further comprises a pair of leg members that are operatively coupled to the work surface and are spaced from the pair of vertical frame members. A rotatable support is operatively coupled to each of the vertical frame members and to each of the leg members. A movable foot is operatively coupled to each of the vertical frame members and to each of the leg members and is configured to support the system in a stationary configuration upon a lowering movement of the movable foot.

In one aspect of the present invention, each of the rotatable supports has a first position in which the movable feet contact the ground and the rotatable supports are spaced apart from the ground and a second position in which the rotatable supports contact the ground and the feet are spaced apart from the ground.

In one aspect of the present invention, each movable foot is movable relative to the framework assembly so as to have a retracted position in which each foot is spaced apart from the ground and an extended position in which each foot contacts the ground.

In one aspect of the present invention, each movable foot extends coaxially from a respective longitudinal axis of one of the vertical frame members and coaxially from a respective longitudinal axis of the leg members.

In one aspect of the present invention, each of the rotatable supports includes a housing that defines a rotational axis and a wheel that is operatively coupled to the housing and is configured to rotate about the rotational axis. The rotational axis is offset from the longitudinal axis of the respective vertical frame member and is offset from the longitudinal axis of the respective leg member.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION

Figure 1:
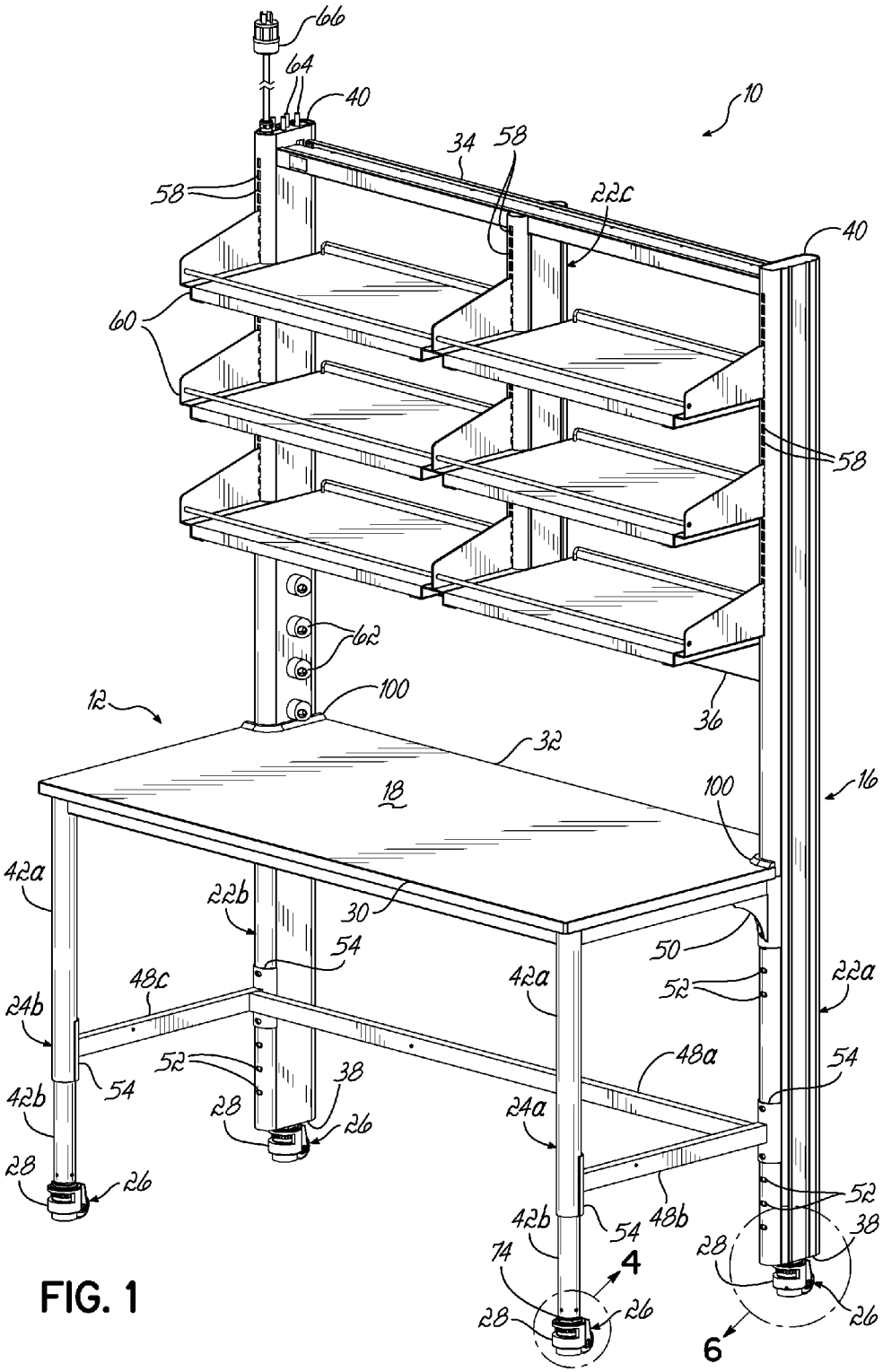
FIG. 1 is a perspective view of an exemplary mobile furniture system in accordance with the principles of the present invention.

FIG. 1 depicts an exemplary mobile furniture system 10 in accordance with the principles of the present invention. In one embodiment, the mobile furniture system 10 comprises a mobile laboratory benching system and includes a single-sided workstation 12 supported by a framework assembly 16. The workstation 12 includes a generally planar work surface, or tabletop 18, that is at least partially supported by vertical frame members 22*a*, 22*b* of the framework assembly 16. As shown, each vertical frame member 22*a* and 22*b* extends above the work surface 18. Leg members 24*a*, 24*b* are operatively coupled to the work surface 18, as shown. In the exemplary embodiment shown, the framework assembly 16, for example, the vertical frame members 22*a*, 22*b*, and each leg member 24*a*, 24*b* are supported on the ground or floor by rotatable supports 26 or feet 28, which are operatively coupled thereto. The rotatable supports 26 are provided to movably support the mobile furniture system 10 when it is desired to move the mobile furniture system 10 between different locations, as will be described in more detail below.

By single-sided workstation, it is meant that the mobile furniture system 10 includes a work surface 18 extending from only one side thereof, and without any work surface extending from an opposite side of the mobile furniture system 10. This embodiment is especially suitable for location along a wall or a partition, although the mobile furniture system 10 may stand apart from any other equipment or structure or, alternatively, may be located back-to-back with another mobile furniture system 10.

With continued reference to FIG. 1, in one embodiment, the mobile furniture system 10 is designed as a mobile or movable configuration. In particular, when the rotatable supports 26, which are described more fully below, are in contact with the floor, the mobile furniture system 10 may be moved from one location to another across the floor. For example, when in the mobile configuration, the mobile furniture system 10 is configured to permit one or more people to push the system 10 to a new location without use of a pallet jack or forklift or without need for multiple people to manually lift and move the system 10.

Furthermore, in at least the mobile configuration, the mobile furniture system 10 is configured to self-correct its orientation relative to the floor when tilted up to about 10° from its normal orientation. In this regard, the mobile furniture system 10 is configured to revert to its normal orientation, in which all of the rotatable supports 26 are in contact with the ground, if the system 10 is tilted by up to about 10°. In the embodiment shown, by tilted it is meant an orientation of the mobile furniture system 10 in which only two of the rotatable supports 26 are in contact with the ground and the work surface 18 forms an angle with the ground. In this regard, embodiments of the mobile furniture system 10 disclosed herein may pass UL testing and be UL 962 (titled "Household and Commercial Furnishings" and which is incorporated by reference herein in its entirety) tested, listed, and labeled.

In addition, in one embodiment, the mobile furniture system 10 has a stationary configuration in which the feet 28 may contact the ground and generally prohibit or limit lateral movement of the system 10 relative to the floor.

Figure 3:
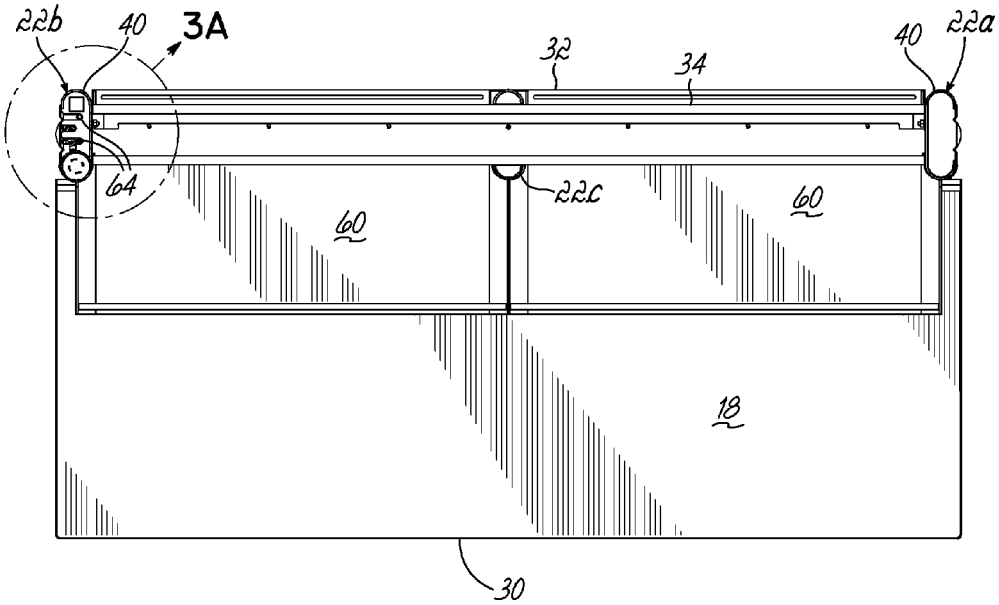
FIG. 3 is a top plan view of the embodiment of the mobile furniture system of FIG. 1.
Figure 3A:
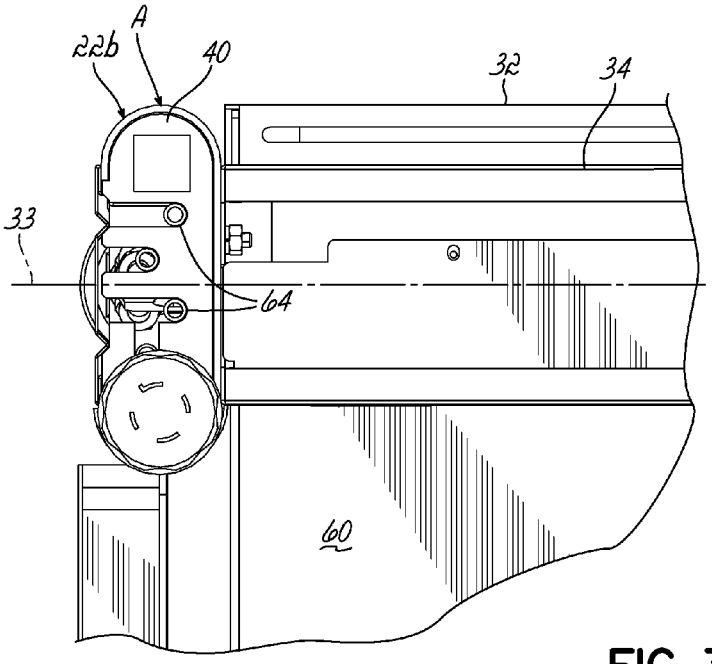
FIG. 3A is an enlarged view of the encircled area 3A of FIG. 3.

To these and other ends and with continued reference to FIG. 1, the work surface 18 has oppositely disposed first and second side edges 30, 32. The work surface 18 is arranged such that the edge 30 may define the front edge and the edge 32 may define the rear edge of the work surface 18. With reference now to FIGS. 3 and 3A, the vertical frame member 22*b* may support the work surface 18 proximate the rear edge 32. The rear edge 32 may be generally in alignment with the rearmost side of the vertical frame member 22*b* (indicated by the arrow A in FIG. 3A). The rear edge 32 may also be generally in alignment with the rearmost side of the vertical frame member 22*a*, as is generally shown in FIG. 3. Thus, in embodiments of the present invention, the edge 32 may extend rearwardly beyond a vertical midplane 33 of each vertical frame member 22*a*, 22*b* up to and including being generally in alignment with rearmost side of the vertical frame members 22*a*, 22*b*. In yet another embodiment (not shown), the rear edge 32 of the work surface 18 extends slightly beyond the respective rearmost sides of the vertical frame members 22*a*, 22*b*.

With continued reference to FIG. 1, the framework assembly 16 includes, in one embodiment, horizontal frame members 34 and 36 that are joined to the vertical frame members 22*a* and 22*b* and together form a support structure for the mobile furniture system 10. In this regard, oppositely disposed ends 40 of each of the vertical frame members 22*a* and 22*b* are positioned above the work surface 18. In one embodiment, a vertical frame member 22*c* may be positioned between the vertical frame members 22*a*, 22*b* and span between horizontal frame members 34 and 36. In the embodiment shown, the vertical frame members 22*a*, 22*b*, 22*c* have generally oblong or ovate cross-sectional geometries, and are described in detail in commonly-owned U.S. Pat. No. 8,186,281, ("'281 patent") issued May 29, 2012, the disclosure of which is incorporated by reference herein in its entirety.

By way of example only, various components of the framework assembly 16 may be formed from sheet metal that has been cut, stamped, bent, welded, or otherwise worked to form the components. Alternatively, it is contemplated that one or more of the components of the framework assembly 16 may comprise extruded aluminum. It will be recognized, however, that the components may alternatively be formed from various other materials and by various other methods, and the invention is not limited to the particular embodiments described herein.

As is described above, the side edge 30 of the work surface 18 is supported by legs 24*a*, 24*b* which may each include first and second telescopingly adjustable leg portions 42*a*, 42*b*. The relative lengths of leg portions 42*a*, 42*b* may be adjusted such that the height of the edge 30 corresponds to the height of the edge 32 above the ground. It will be appreciated that adjusting the leg portions 42*a*, 42*b* of each of leg members 24*a*, 24*b* may be required where it is desired to have the work surface 18 substantially level in one or both of the stationary configuration and the movable configuration, described below. Further in this regard, in the embodiment shown, the rear edge 32 of the work surface 18 is secured to the vertical frame members 22*a*, 22*b* by height-adjustable brackets 50. The brackets 50 may be selectively positioned in any of a plurality of apertures 52 provided on the vertical frame members 22*a*, 22*b*.

With continued reference to FIG. 1, in one embodiment, the frame assembly 16 may further include stretcher members 48*a*, 48*b*, and 48*c*. The stretcher member 48*a* may extend between and be coupled to the vertical frame members 22*a* and 22*b*. Similarly, the stretcher members 48*b* and 48*c* may extend between and be coupled to a respective leg member 24*a*, 24*b* and a corresponding one of the vertical frame members 22*a*, 22*b*. As shown, the stretcher members 48*a*, 48*b*, and 48*c* may be coupled to the respective vertical frame members 22*a*, 22*b* and to the respective leg members 24*a*, 24*b* via brackets 54 that are vertically adjustable along apertures 52. Furthermore, in the exemplary embodiment shown, the stretcher member 48*a* may extend between the stretcher members 48*b* and 48*c*, rather than directly between the vertical frame members 22*a*, 22*b*. In this embodiment, the stretcher member 48*a* may be spaced to the inside of the vertical frame members 22*a*, 22*b* or nearer to the front edge 30 than the vertical frame members 22*a*, 22*b* are to the front edge 30. Advantageously, it will be appreciated that placement of the stretcher member 48*a* nearer to the front edge 30 than the vertical frame members 22*a*, 22*b* may move the center of gravity of the system 10 in the same direction while providing improved mechanical stability.

With continued reference to FIG. 1, in one embodiment, a plurality of apertures 58 are provided proximate the ends 40 of the vertical frame members 22*a*, 22*b* and are arranged to extend lengthwise along the vertical frame members 22*a*, 22*b* in directions toward the ends 38. Apertures 58 may also be used to secure and support cabinets, tack boards, dividers and various other accessories (not shown) on only one side of the vertical frame members 22*a*, 22*b*. In the embodiment shown, the apertures 58 are configured to removably mount one or more shelves 60 to the vertical frame members 22*a*, 22*b*. In this regard, when it is desired to have shelves 60 or other accessories that do not extend the entire span between the vertical frame members 22*a*, 22*b*, the intermediate vertical frame member 22*c* with corresponding apertures 58 may serve as an intermediate support for such accessories.

Figure 2:
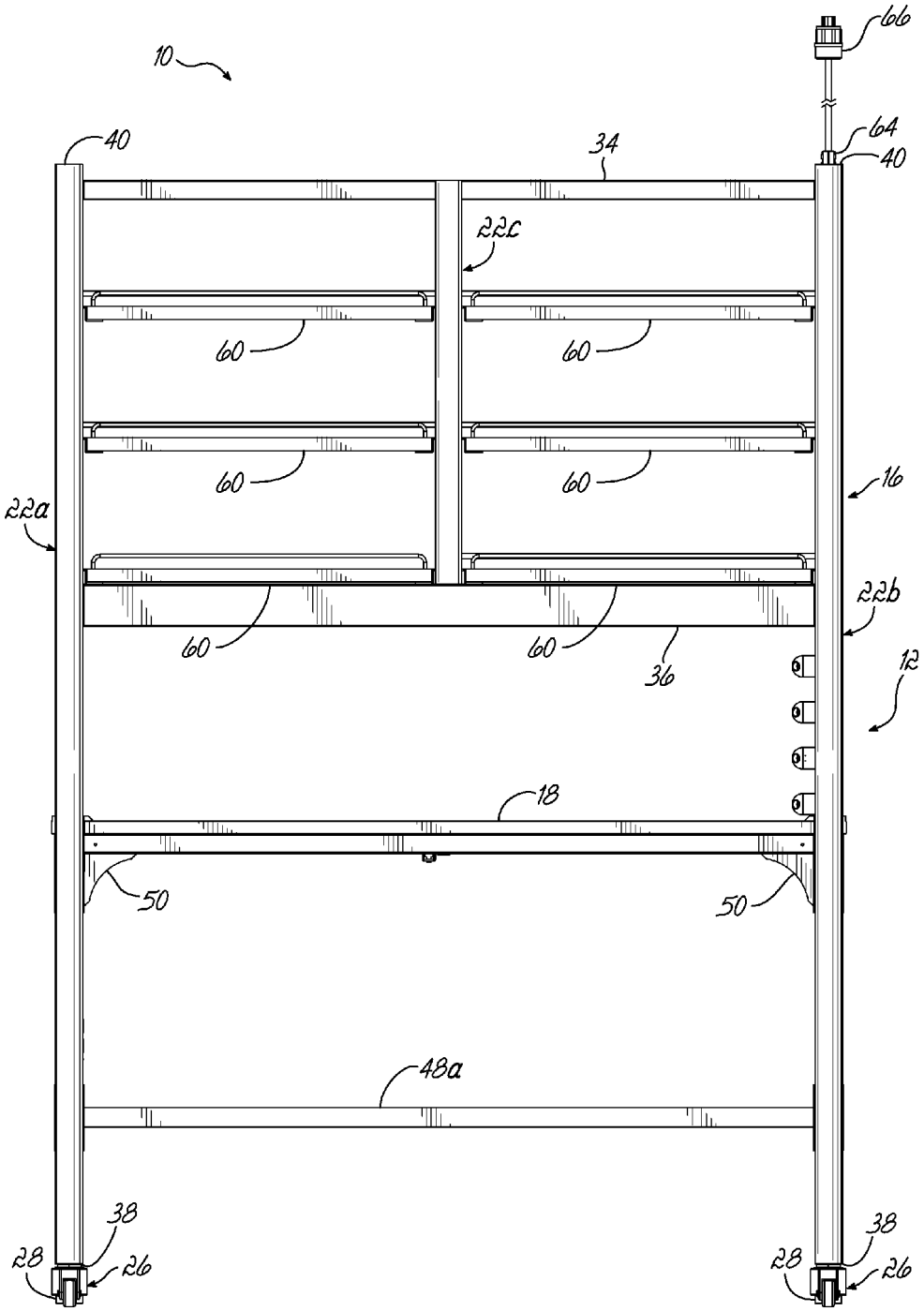
FIG. 2 is a rear elevational view of the embodiment of the mobile furniture system of FIG. 1.

With reference to FIG. 2, and by way of comparison with FIG. 1, in one embodiment, each of the vertical frame members 22*a* and 22*b* are free of apertures 58 along the height of the rearwardly facing side of the mobile furniture system 10. The absence of the apertures 58 on this side of the mobile furniture system 10 generally discourages people from hanging or otherwise attaching additional structures or items to the rear side of the mobile furniture system 10. By discouraging attachment on the rearwardly facing side, the center of gravity of the mobile furniture system 10 may be more consistently positioned in a location in which the system 10 is less likely to inadvertently be tilted to an unstable position, particularly in the direction of the rearwardly facing side. Thus, the absence of the apertures 58 facilitates a more stable configuration, particularly when the mobile furniture system 10 is in a mobile configuration. It will be appreciated that the vertical frame members 22*a* and 22*b* may also be free of other structures to which additional items may be attached for the same reason set out above.

The mobile furniture system 10 may be configured to provide various utility services to locations adjacent the work surface 18, such as gas, liquid, vacuum, electric, and data services, for example, in a similar manner as fully described in the '281 patent incorporated herein by reference. In the embodiment shown in FIG. 1, fluid service lines (not shown) for providing gas, liquid, or vacuum service, and electric and data service lines may be routed from a location above the mobile furniture system 10, such as through a ceiling, and through the framework assembly 16 to various fluid service fixtures 62 and outlets 63 (shown in FIG. 7) provided on the framework assembly 16. For example, utility source gases may be removably coupled to conduits 64 to provide selected gases to the fixture 62. By way of further example, a source of electrical power may be connected to the various electrical outlets on the mobile furniture system 10 by removably coupling an electrical plug 66 to an outlet (not shown) in the ceiling or in the floor of the facility. While the utility services connections, i.e., the plug 66 and the conduits 64, are shown extending from the end 40 of the vertical frame member 22*b* to be coupled to corresponding utilities in a ceiling, it will be appreciated that the utilities may be routed from a floor, from a wall, or from various other locations provided in a building structure in which the furniture system 10 may be located. As such, embodiments of the present invention are not limited to having utility source connections in the end 40. In other embodiments, no utility services are provided as they may not be required for a particular workstation environment.

Figure 4:
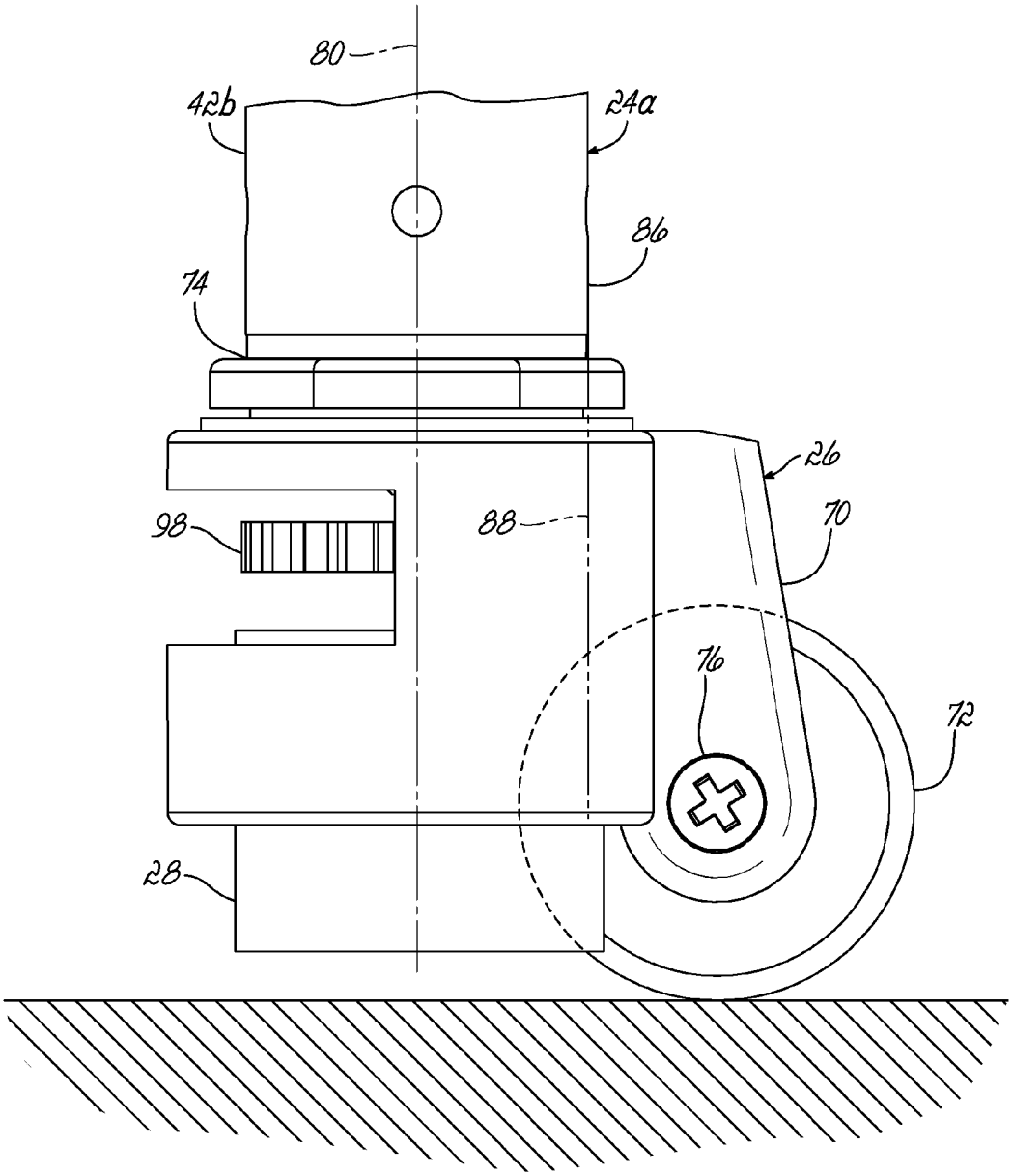
FIG. 4 is an enlarged side view of the encircled area 4 of FIG. 1 depicting a rotatable support and a foot according to one embodiment of the invention.

With reference now to FIGS. 1 and 4, in one embodiment of the mobile furniture system 10, the rotatable support 26 includes a housing 70 and a rotatable wheel 72. By way of example only, and not limitation, the rotatable support 26 may be a caster. As is known, a caster may include a free-spinning wheel mounted in a stationary fork. Furthermore, a caster may be rigidly coupled to the leg member 24*a* so that the orientation of its wheel is fixed or, alternatively, the caster may include a swivel such that the wheel automatically aligns itself with the direction of travel as the wheel rotates. A swivel may permit the housing 70 to rotate 360° around an axis that is generally perpendicular to the axis about which the wheel rotates. Exemplary commercially available casters suitable for use in the present invention include part number SLL0300-M12-1.75DT-NY available from Algood Casters Limited of Toronto, Ontario Canada.

In this regard and with continued reference to FIG. 4, in one embodiment, the housing 70 is operatively coupled to a respective leg member 24*a* proximate end 74 of the leg member 24*a*. The housing 70 defines a rotational axis 76, and the wheel 72 is operatively coupled to the housing 70 so as to be rotatable about the rotational axis 76. In one embodiment, the leg member 24*a* has a longitudinal axis 80 that extends vertically and is oriented generally perpendicular to the work surface 18 (FIG. 1). As shown in FIG. 4, the rotational axis 76 of the wheel 72 may be oriented perpendicular to the axis 80 and may be laterally offset therefrom. By way of example only, and without limitation, the offset between the axis 76 and the axis 80, as measured by a perpendicular distance from the axis 80 to the axis 76, may be from about 1¼ inches to about 2 inches. It will be appreciated that the offset between the axes 76 and 80 may depend upon the size of the wheel 72, among other factors. Further, the offset between axes 76 and 80 may be limited such that a portion of the rotatable support 26 is in vertical alignment with the leg member 24*a*. As used herein, vertical alignment means that a portion of the rotatable support 26 resides within a vertical projection of the outermost periphery of the respective leg member 24*a*, 24*b*. With reference to FIG. 4, it will be appreciated that a portion of the wheel 72 resides within a downward projection of an outermost periphery 86 of the leg member 24*a*, as is indicated by broken line 88.

In one embodiment, the housing 70 is coupled to the leg member 24*a* so that the housing 70 may rotate relative to the axis 80 during movement of the mobile furniture system 10. With reference to FIG. 1, in one embodiment, a similar rotatable support 26 as that shown in FIG. 4 may be operatively coupled to the leg member 24*b*. However, embodiments of the present invention are not limited to each leg member 24*a*, 24*b* having a similar rotatable support. Specifically, each leg member 24*a*, 24*b* may have a different rotatable support. By way of example only, one leg member 24*a* or 24*b* may have a rigid caster operatively coupled thereto with the other leg member 24*a* or 24*b* having a swivel caster operatively coupled thereto.

Figure 6:
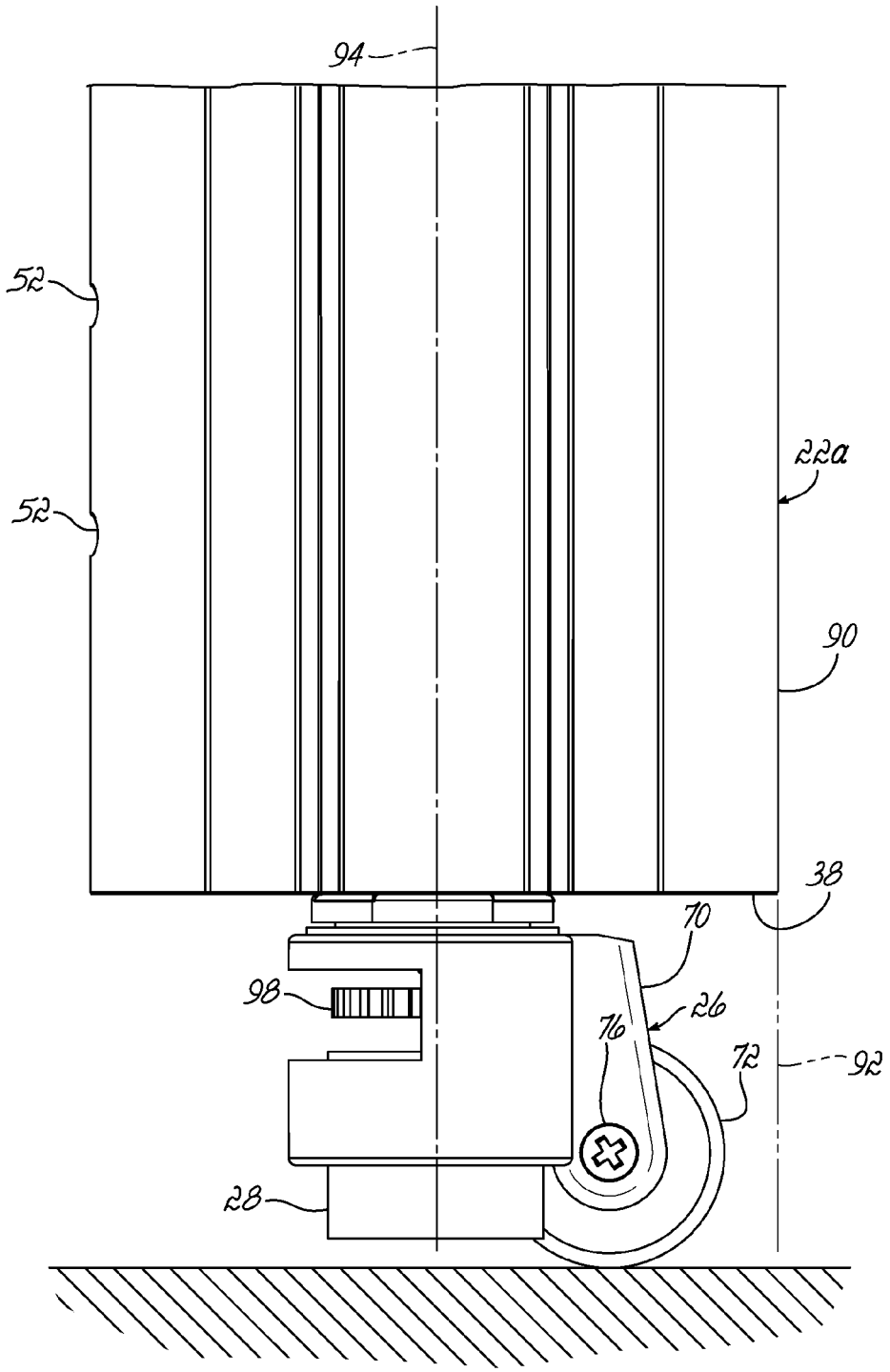
FIG. 6 is an enlarged side view of the encircled area 6 of FIG. 1 depicting a rotatable support and a foot according to one embodiment of the invention.

With reference now to FIGS. 1 and 6 in which like reference numerals refer to like features in FIG. 4, in one embodiment, a rotatable support 26 may be operatively coupled to the end 38 of the vertical frame member 22*a*. As shown, the rotatable support 26 may be substantially similar to the rotatable support 26 operatively coupled to the leg member 24*a*, as described above and depicted in FIG. 4. In this regard and with reference to FIG. 6, in one embodiment, the housing 70 includes a swivel 82. In this embodiment, the housing 70 is operatively coupled to the vertical frame member 22*a* via the swivel 82 so that the housing 70 may rotate about a longitudinal axis 94 during movement of the mobile furniture system 10. By way of example only, and not limitation, the rotatable support 26 may be a caster, such as, a rigid caster or a swivel caster. Exemplary commercially available casters suitable for use in the present invention include part number SLL0300-M12-1.75DT-NY swivel casters available from Algood Casters Limited of Toronto, Ontario Canada.

In one embodiment, the housing 70 is operatively coupled to the vertical frame member 22*a* along longitudinal axis 94 thereof so as to offset the rotational axis 76 from the longitudinal axis 94. The offset may be limited to a distance at which at least a portion of the rotatable support 26 shown in FIG. 6 is in vertical alignment with the vertical frame member 22*a*. As shown, an outermost periphery 90 of the vertical frame member 22*a* defines a downwardly extending projection 92. At least a portion of the rotatable support 26 resides within the projection 92 of the outermost periphery 90. In one embodiment, in the orientation shown in FIG. 6, the rotatable support 26 resides completely within the downwardly extending projection 92 of the outermost periphery 90. By way of example only, and not limitation, the offset between the rotational axis 76 and the longitudinal axis 94, as measured by a perpendicular distance from the axis 94 to the axis 76, may be from about 1¼ inches to about 2 inches.

With reference to FIG. 1, in one embodiment, a similar rotatable support 26 as that shown in FIG. 6 may be operatively coupled to the vertical frame member 22*b*. In the representative embodiment, the same style of rotatable support is operatively coupled to each of the vertical frame members 22*a*, 22*b* and each of the leg members 24*a*, 24*b*. In this regard, each rotatable support 26 may be a swivel leveling caster. However, embodiments of the present invention are not limited to each vertical frame member 22*a*, 22*b* and each leg member 24*a*, 24*b* having a similar rotatable support. In this regard, each member 22*a*, 22*b*, 24*a*, 24*b* may have a different rotatable support. By way of example only, one vertical frame member may have a rigid caster operatively coupled thereto with the other vertical frame member having a swivel leveling caster operatively coupled thereto. By way of additional example, a swivel leveling caster may be operatively coupled to the vertical frame member 22*a* or 22*b* and to the leg member 24*a* or 24*b* with a rigid caster being operatively coupled to the other vertical frame member 22*b* or 22*a* and to the leg member 24*b* or 24*a*. It will be appreciated that other combinations of rotatable supports are also possible and embodiments of the present invention are not limited to any particular configuration of rotatable supports.

Figure 5:
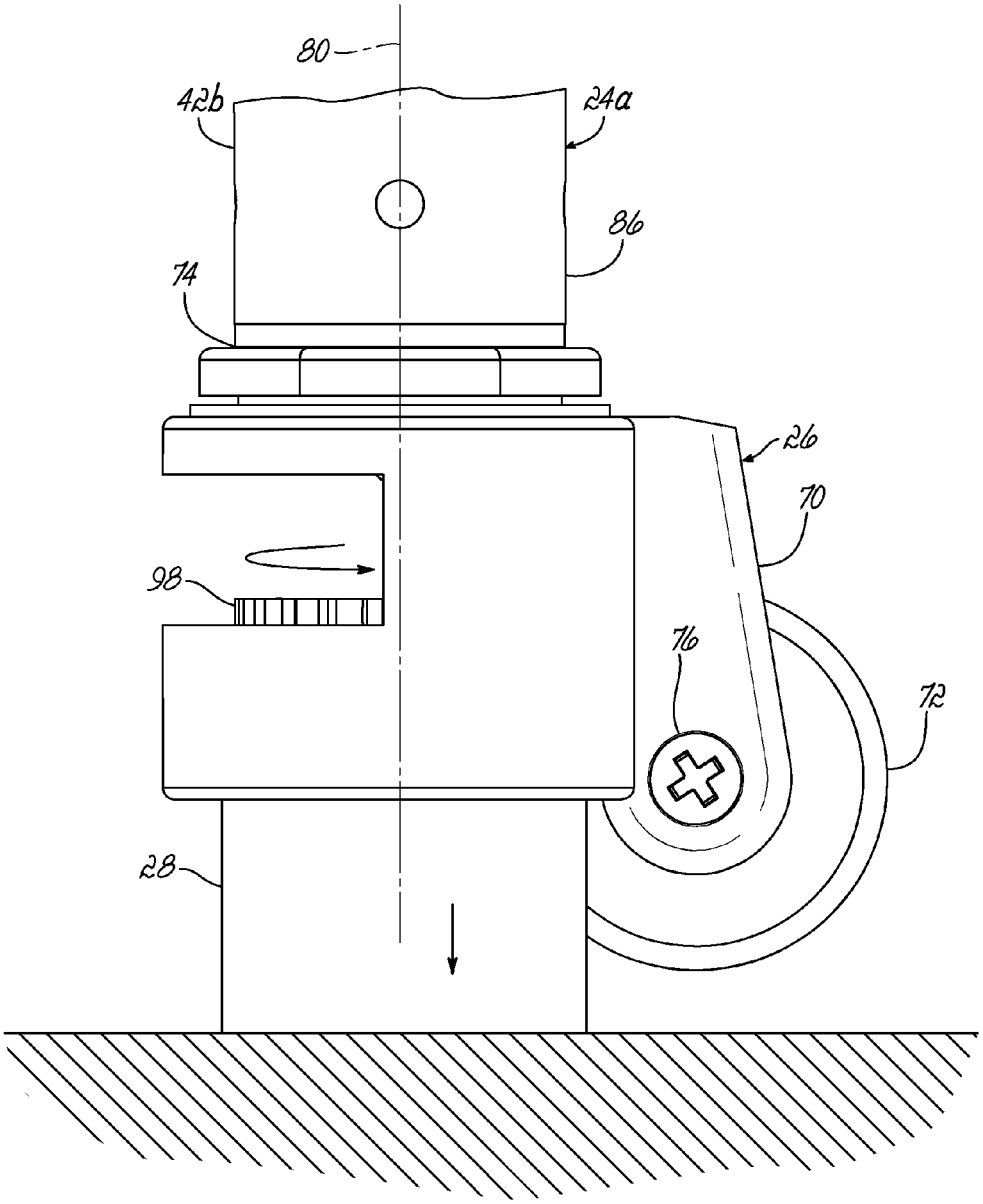
FIG. 5 depicts the rotatable support and the foot of FIG. 4 with the foot shown in an extended position according to one embodiment of the invention.

As described above, in one embodiment and with reference to FIGS. 1, 4, and 5, the mobile furniture system 10 may include one or more feet 28 operatively coupled to the leg members 24*a*, 24*b*. It will be appreciated that a foot 28 may be operatively coupled to any or all of the vertical frame members 22*a*, 22*b*. With reference to FIG. 1, in an exemplary embodiment, one foot 28 may be operatively coupled to each of the vertical frame members 22*a*, 22*b* and to each of the leg members 24*a*, 24*b*. Thus, in the embodiment shown, the mobile furniture system 10 includes four feet 28 and four rotatable supports 26.

With reference specifically to FIGS. 4 and 5, the foot 28 is operatively coupled so as to be movable relative to the leg member 24*a* and to the rotatable support 26. In this regard, the foot 28 may be substantially in alignment with and moved along the longitudinal axis 80 between a retracted position, as is shown in FIG. 4, to an extended position, as is shown in FIG. 5.

In the retracted position (FIG. 4), the wheel 72 may be in contact with the floor such that a portion of the weight of the mobile furniture system 10 resides on the wheel 72. Movement of the mobile furniture system 10 relative to the floor will cause the wheel 72 to rotate. With reference to FIG. 1, in the embodiment shown, which includes four feet 28, when all of the feet 28 are in their respective retracted positions, each rotatable support 26 contacts the floor. The mobile furniture system 10 may then be movable relative to the floor on the rotatable supports 26. In this configuration, a person may push the mobile furniture system 10 to a new location.

When the foot 28 is in the extended position (FIG. 5), the foot 28 is in contact with the floor so that the wheel 72 is spaced above the floor. The foot 28 may then carry a portion of the weight of the mobile furniture system 10 and may substantially prevent lateral movement of the mobile furniture system 10 across the floor. In the exemplary embodiment shown, a knob 98 may be rotated by hand or with a tool (not shown). Rotation of the knob 98 selectively extends the foot 28 along the longitudinal axis 80 until it contacts the floor. Further extension of the foot 28 along the axis 80 may shift a portion of the load of the mobile furniture system 10 onto the foot 28 and consequently may reduce the load on the respective wheel 72 until there is no load on the wheel 72. By way of example only, the difference in height between the extended position of the foot 28 and the retracted position of the foot 28 may be sufficient to shift the load from the foot 28 to the wheel 72. By way of further example, the difference in height between the extended and retracted position of the foot 28 may be from about ¼inch to about 1¼% inch.

Once the mobile furniture system 10 is relocated, in the configuration where each foot 28 is in the retracted position, each of the feet 28 may be extended to lift each wheel 72 from contact with the floor. Once one or more of the feet 28 are extended, so as to lift the respective wheel 72 from contact with the floor, the mobile furniture system 10 may resist lateral movement that would otherwise have moved the mobile furniture system 10 when in the mobile configuration. It will be appreciated that extending each of the feet 28 to lift the respective rotatable supports 26 from the floor may provide a stable, stationary configuration for use on a day-to-day basis.

In the exemplary embodiment shown, and with reference to FIGS. 1, 4, and 6, the rotatable support 26 may include a leveling caster. In this regard, the wheel 72 and the foot 28 may be operatively coupled together within the housing 70. By way of example only, and not limitation, leveling casters are commercially available, such as those available from Algood marketed as the LL series. It will be appreciated, however, that the feet 28 and the rotatable support 26 may not be associated with a single caster. That is, the feet 28 may be separately coupled to the respective member as a separate component from the rotatable supports 26.

Furthermore, while the feet 28 are described herein as being movable with respect to the rotatable support 26, the reverse configuration is also contemplated. That is, the rotatable support 26 may be operatively coupled to the respective frame members 22*a*, 22*b* and/or leg members 24*a*, 24*b* so as to have an extended position and a retracted position. In the extended position, each rotatable support 26 may contact the floor so that the mobile furniture system 10 is movable. And, when the rotatable support 26 is in the retracted position, the feet 28 are in contact with the floor such that the mobile furniture system 10 resists movement and provides a stable, stationary configuration for day-to-day use.

Figure 7:
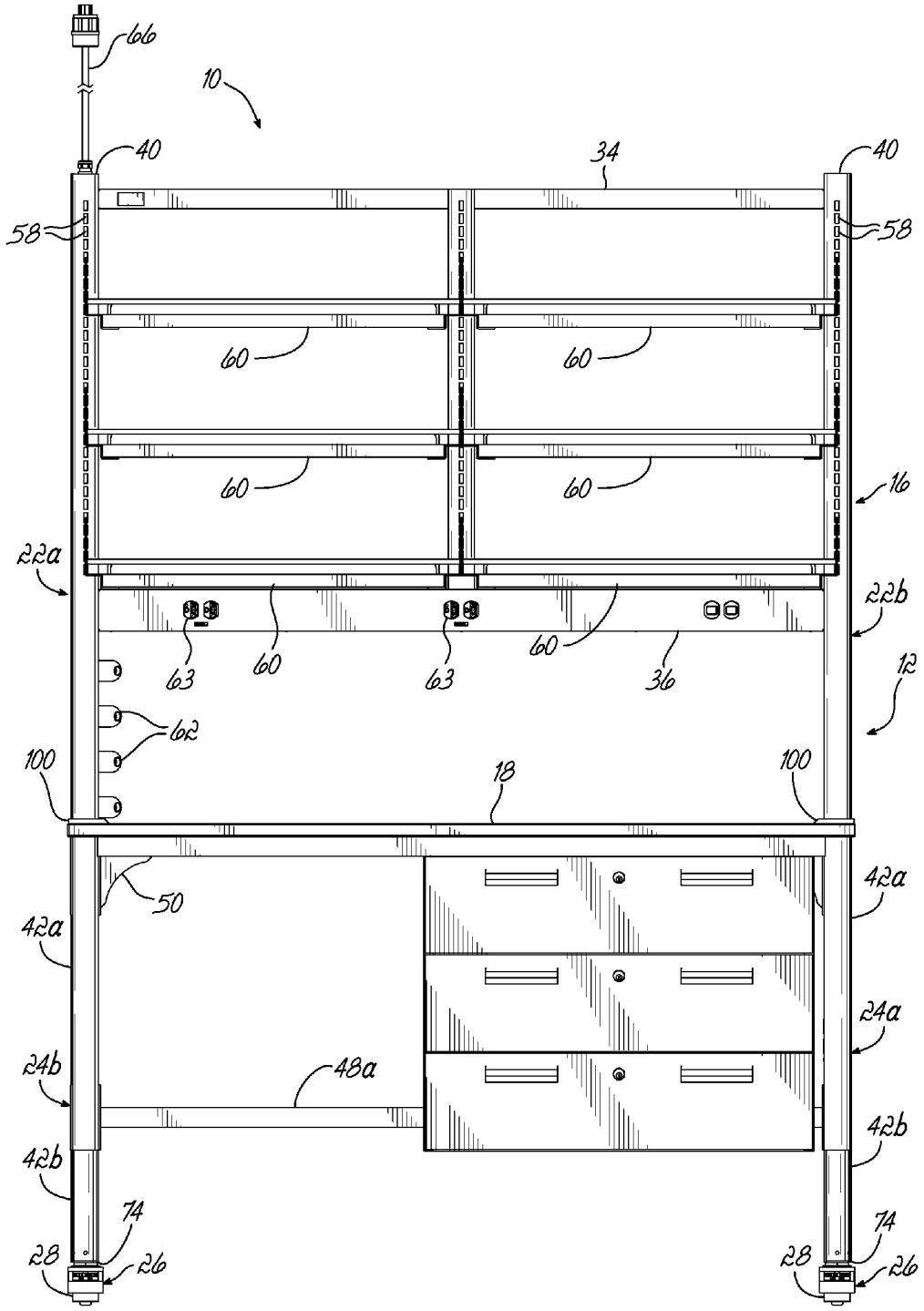
FIG. 7 is a front view of one embodiment of the mobile furniture system.

With reference to FIGS. 1 and 7, in one embodiment, the work surface 18 includes a raised lip 100 at locations on the work surface 18 that are proximate each of the vertical frame members 22*a*, 22*b*. The raised lip 100 may protrude upwardly and may generally prevent spilled liquids or other substances from flowing across the work surface 18 and passing between the work surface 18 and either of the vertical frame members 22*a*, 22*b*. In this regard, the raised lip 100 may ease cleanup of accidental spills and may generally facilitate keeping the work surface 18 clean.

In addition, and with reference to FIG. 7, in one embodiment, the mobile furniture system 10 may include one or more drawers or sliding cabinets 102. As shown, the cabinets 102 may be operatively coupled underneath the work surface 18 to the leg member 24*a* and vertical frame member 22*a*. As is known, the cabinets 102 may be used to store equipment not in use. The cabinets 102 may extend partway across the full width of the mobile furniture system 10. Although not shown, it will be appreciated that the cabinets 102 may extend the full width of the space available beneath the work surface 18.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A single-sided mobile furniture system, comprising:

a tabletop defining a substantially horizontal work surface and having a front edge, a rear edge, and a left and right edge;

a framework assembly comprising a pair of vertical frame members configured to support the tabletop, each of the vertical frame members extending vertically at opposing ends of the rearward edge of the tabletop and extending above the tabletop;

at least one utility service line routed through at least a portion of the framework assembly and being configured to be removably coupled to at least one fixed utility source;

a pair of leg members operatively coupled proximate the front edge of the tabletop and spaced from the pair of vertical frame members;

a rotatable support operatively coupled to each of the vertical frame members and to each of the leg members, respectively; and a movable foot operatively coupled to each of the vertical frame members and to each of the leg members, respectively, and being configured to support the system in a stationary configuration upon a lowering movement of the movable foot;

wherein the rotatable supports are fixed behind the feet such that in a first tilted position, the rotatable supports contact the ground and the feet do not contact the ground.

2. The furniture system of claim 1, wherein each of the rotatable supports has a first position in which the movable feet contact the ground and the rotatable supports are spaced apart from the ground, and a second position in which the rotatable supports contact the ground and the feet are spaced apart from the ground.

3. The furniture system of claim 1, wherein each movable foot is movable relative to the framework assembly so as to have a retracted position in which each foot is spaced apart from the ground and an extended position in which each foot contacts the ground.

4. The furniture system of claim 1, wherein each movable foot extends coaxially from a respective longitudinal axis of one of the vertical frame members and coaxially from a respective longitudinal axis of the leg members.

5. The furniture system of claim 1, wherein each of the rotatable supports includes a housing that defines a rotational axis and a wheel that is operatively coupled to the housing and is configured to rotate about the rotational axis, the rotational axis being offset from the longitudinal axis of the respective vertical frame member and being offset from the longitudinal axis of the respective leg member.

6. The furniture system of claim 1, wherein at least one of the rotatable supports comprises a caster.

7. The furniture system of claim 6, wherein the caster is a swivel caster.

8. The furniture system of claim 6, wherein the caster is a swivel leveling caster.

9. A single-sided mobile furniture system, comprising:

a tabletop defining a substantially horizontal work surface having a front edge, a rear edge, and a left and right edge;

a framework assembly comprising a first and second vertical frame members configured to support the tabletop, each of the vertical frame members extending vertically at opposing ends of the rearward edge of the tabletop and extending above the tabletop;

at least one utility service line routed through at least a portion of the framework assembly and being configured to be removably coupled to at least one fixed utility source;

a first and second rotatable support operatively coupled to the first and second vertical frame members, respectively, the first and second rotatable support comprising a housing and a rotatable wheel supported by the housing, at least a portion of each of the rotatable supports being in vertical alignment with a respective one of the vertical frame members;

a first second foot operably coupled to the first and second vertical frame members, respectively, and fixed forward with respect to the wheel;

a first and second leg members operatively coupled to the front edge of the tabletop and spaced from the first and second vertical frame members; and a third and fourth rotatable support operatively coupled to the first and second leg members, respectively, and the third and fourth rotatable support comprising a housing and a rotatable wheel supported by the housing, at least a portion of each of the rotatable supports being in vertical alignment with a respective one of the vertical frame members a third and fourth foot operably couple to the first and second leg members, respectively.

10. The furniture system of claim 9, wherein the framework assembly includes a first stretcher member extending between the first and second vertical frame members, a second stretcher member extending between the first leg member and the first vertical frame member, and a third stretcher member extending between the second leg member and the second vertical frame member, and wherein the first, second, and third stretcher members are fixed with respect to each other and vertically adjustable with respect to the framework assembly.

11. The furniture system of claim 9, wherein the rear edge is generally in alignment with a rear side of each vertical frame member.

12. The furniture system of claim 9, wherein the rear edge extends rearwardly beyond a vertical midplane of each vertical frame member.

13. The furniture system of claim 9, wherein each of the vertical frame members include a plurality of apertures that are configured to removably mount a shelf to the vertical frame members that overlies the work surface.

14. The furniture system of claim 9, wherein a rear side of each of the vertical frame members that faces away from the front edge is free of apertures.

15. The furniture system of claim 9, wherein the work surface includes a raised lip located proximate each of the vertical frame members.

16. The furniture system of claim 9, wherein at least one of the first and second rotatable supports includes a caster.

17. The furniture system of claim 16, wherein the caster is a swivel caster.

18. The furniture system of claim 16, wherein the caster is a leveling caster.

* * * * *